United States Patent [19]

Palacio et al.

[11] Patent Number: 4,490,956

[45] Date of Patent: Jan. 1, 1985

[54] TRUSS SPACER

[75] Inventors: Joaquin J. Palacio; Carlos C. Cristobal, both of Miami, Fla.

[73] Assignee: Gang-Nail Systems, Inc., Miami, Fla.

[21] Appl. No.: 456,342

[22] Filed: Jan. 7, 1983

[51] Int. Cl.[3] ..... E04B 1/32

[52] U.S. Cl. ..... 52/639; 52/696; 52/712; 52/DIG. 6; 411/466

[58] Field of Search ..... 52/693-696, 52/639, 712, DIG. 6; 403/232.1, 283, 406; 411/466

[56] References Cited

U.S. PATENT DOCUMENTS

| | | | |
|---|---|---|---|
| 2,877,520 | 3/1959 | Juriet | 403/283 |
| 3,025,577 | 3/1962 | Juriet | 52/693 |
| 3,298,151 | 1/1967 | Juriet | 52/696 |
| 3,633,454 | 1/1972 | Schmitt | 411/466 |
| 4,078,352 | 3/1978 | Knowles | 52/693 |
| 4,246,736 | 1/1981 | Kovar et al. | 52/696 |
| 4,366,659 | 1/1983 | Jensen | 52/693 |

*Primary Examiner*—Henry E. Raduazo

*Attorney, Agent, or Firm*—LeBlanc, Nolan, Shur & Nies

[57] ABSTRACT

A truss spacer for rigidly interconnecting and maintaining spacing between adjacent spaced apart trusses and a truss structure constructed using such truss spacers. The truss spacer includes first and second connecting plates disposed in a plane. The first and second connecting plates each have a plurality of teeth projecting generally orthogonally from a surface of the connecting plate in the same direction. The truss spacer also has an intermediate section having a first end and a second end, the first end being connected to the first connecting plate and the second end being joined to the second connecting plate. A pair of spacing members are joined respectively to the first and second ends of the intermediate section. The spacing members project generally orthogonally from the intermediate section in the same direction as the teeth project from the first and second connecting plates. The spacing members are spaced apart by a distance equal to the desired distance between adjacent surfaces of spaced apart trusses to which the first and second connecting plates are adapted to be connected. The intermediate section is stiffened to resist bending and torsional forces upon the application of loads. The intermediate section has a first and second ends connected to the plates and second and third sections which are connected respectively to first and second outside edges of the first section which project in the same direction as the teeth of the first and second connecting plates.

4 Claims, 5 Drawing Figures

TRUSS SPACER

BACKGROUND OF THE INVENTION

1. Field of the Invention

The invention relates to truss spacers which are used at building sites for rigidly interconnecting adjacent trusses and producing uniform spacing between a series of trusses which are oriented parallel to each other.

2. Description of the Prior Art

A prior art method for obtaining uniform spacing between adjacent trusses is to nail 1"×2" wood strips between adjacent trusses as they are being erected at the building site to maintain uniform spacing. The use of wood strips requires the use of fasteners at the construction site to attach the strips between adjacent trusses. After the strips are nailed on top of the trusses they must be removed before the roofing or other materials are applied.

U.S. Pat. No. 3,959,945 discloses the use of roof truss spacers each of which is nailed by a single nail to either the top and the bottom of the truss at a manufacturing site. By using only a single nail to attach the spacer, the spacer can be pivoted with respect to the truss. At the manufacturing site of the truss, the spacers are rotated to be parallel to the longitudinal axis of the truss when transporting the truss. At the time of erection of the truss at the construction site, the spacers are rotated to be orthogonal to the longitudinal axis of the truss to which they are attached. When each spacer is rearranged so as to be orthogonal to the longitudinal axis of the truss, the spacer is nailed to the adjacent truss, again by a single nail, to maintain uniform spacing between the adjacent trusses. The free end of each of the spacers may be either nailed to the adjacent truss at the same longitudinal position as another spacer which is nailed to the adjacent truss or they may be longitudinally offset with respect thereto. The section of the spacer extending between the adjacent trusses has an "L" shaped cross-section. The spacing members may be left in place after the installation of the roof sheeting or decking to the trusses. Spacing between adjacent trusses is maintained by the length of the downwardly extending leg. Such spacers in accordance with this U.S. Pat. No. 3,959,945 fail to provide adequate rigid structural support between adjacent truss members. In addition, the difference between the length of the respective legs of the spacer prevents the manufacture of the spacer from a rectangular blank of metal and necessitates the use of more intricately shaped metal blanks and wastes metal in comparison to spacers formed from a single rectangular blank. Various types of elongated metal connecting members are currently being used in constructing both roof trusses and floor trusses, or joists. Such metal connecting members are being used in place of some of the wooden members. Examples of such metal connecting members are illustrated in U.S. Pat. Nos. 3,025,577 and 3,298,151 to Jureit and 4,078,352 to Knowles as well as the commonly assigned U.S. patent application Ser. No. 337,671 entitled TRUSS STRUCTURES CONSTRUCTED WITH METAL WEB MEMBERS and filed Jan. 7, 1982.

SUMMARY OF THE INVENTION

An object of the present invention is to provide a rigid truss spacing member for providing rigid structural connection and support between adjacent trusses.

Another object of the present invention is to provide an improved truss spacer which may be used to uniformly space trusses without the utilization of extensive labor while providing high rigidity between adjacent trusses both while plywood or other wooden members are being attached to adjacent trusses and after completion of the entire truss structure.

A further object of the present invention is to provide a rigid truss spacer which is capable of withstanding substantially compressive and torsional forces and may be attached to trusses at the construction site without the use of nails or other fasteners which are not integrally formed in the spacer while providing rigidity between adjacent trusses during the attachment of plywood or other wooden members.

A still further object of the present invention to provide a truss spacer which may be manufactured from a rectangular metal blank by a combination of punching and metal forming operations.

A truss spacer in accordance with the present invention for serving as a rigid support member interconnecting adjacent trusses and maintaining spacing between adjacent spaced apart trusses includes a rigid intermediate section having at its ends first and second connecting plates that are disposed in the same plane. Each of the plates have a plurality of teeth projecting generally orthogonally from a surface of each of the connecting plates which extend in the same direction. The rigid intermediate section joins together the first and second connecting plates. The intermediate section has a first end and a second end, the first end being joined to the first connecting plate and first and second spacing members are formed within the first and second ends respectively of the intermediate section. These first and second spacing members project generally orthogonally from the intermediate section in the same direction that the teeth project from the first and second connecting plates. These two spacing members are spaced apart by a distance equal to the desired distance between facing surfaces of adjacent spaced apart trusses to which the first and second connecting plates are to be connected. The rigid intermediate section is sufficiently stiffened to resist bending and torsional forces upon the application of a load both on the individual trusses during construction and the entire truss structure once constructed.

In order that the truss spacer be able to provide sufficient support between the adjacent spaced trusses and aid in increasing the rigidity of the overall truss structure the intermediate section of each of the truss spacers has a generally U-shape cross-section. This intermediate section has a first section disposed in the same plane as the first and second plates and second and third sections which are orthogonal to the first section and project from the outside edges of the first section in the same direction as the teeth of the first and second plates. The first, second and third sections are of equal length.

The truss spacer is manufactured from a rectangular blank of metal by a combination of metal forming and punching operations.

DESCRIPTION OF THE PREFERRED EMBODIMENT

Figure 1:
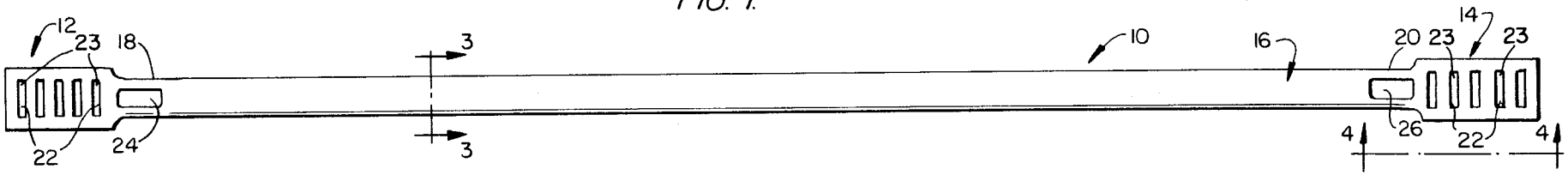
FIG. 1 is a top view of the present invention.
Figure 4:
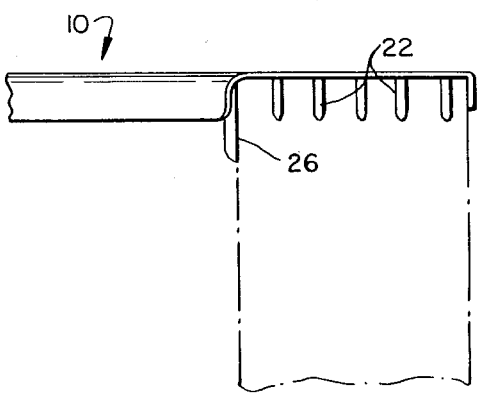
FIG. 4 is a sectional view of FIG. 1 taken along section line 4—4 but with a partial illustration of such section being connection to a wooden member of a truss.
Figure 3:
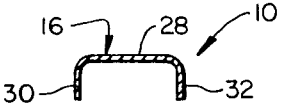
FIG. 3 is a sectional view of FIG. 1 taken along section line 3—3.
Figure 2:
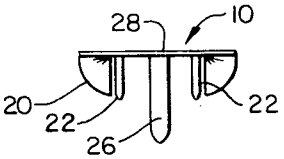
FIG. 2 is an end view of the present invention.

A truss spacer 10 in accordance with the present invention is illustrated in FIGS. 1 through 5. The truss spacer 10 has a first connecting plate 12 and a second connecting plate 14 which are spaced apart by an intermediate section 16. The first connecting plate 12 is attached to the first end 18 of the intermediate section 16. The second connecting plate 14 is attached to the second end 20 of the intermediate section 16.

The first connecting plate 12 and the second connecting plate 14 each have a plurality of teeth 22 struck out from the metal so as to leave slots 23. Teeth 22 project generally orthogonally in the same direction from one surface of the connecting plates. Preferably the teeth 22 are manufactured in accordance with the teachings of U.S. Pat. No. 4,343,580, which is assigned to the same assignees as the present application. As shown in said U.S. Pat. No. 4,343,580, pairs of teeth (such as indicated at 22) are struck from the same slot (such as indicated at 23) and the teeth project generally orthogonally in the same direction from one surface of the connecting plates (generally indicated at 12 and 14) with one tooth of each pair of teeth being located at one of the two opposite ends of the slot.

A first spacing member 24 is punched out of the first end 18 of the intermediate section 16 and leaves a slot 25. The first spacing member 24 projects generally orthogonally from the first end 18 in the same direction as the teeth 22 project. A second spacing member 26 is punched out of the second end 20 of the intermediate section 16 and leaves a slot 27. The second spacing member 26 projects generally orthogonally from the second end 20 of the intermediate section 16 in the same direction as the teeth 22 project. The distance between the first spacing member 24 and the second spacing member 26 determines the desired distance between adjacent surfaces of adjacent trusses.

The intermediate section is stiffened to resist bending and torsional forces upon the application of loads both on the individual trusses during construction and the fully constructed truss structure. By increasing rigidity of the truss structure and strengthening between the truss members, the entire truss structure is better able to withstand various forces, such as wind forces, to which the completed truss structure is subjected. The strength of the intermediate section 16 is important in maintaining a rigid interconnection between adjacent trusses. A rigid interconnection of a series of parallel spaced apart trusses is important during the attachment of plywood or other wooden members to the top surfaces of the trusses and helps contribute to the overall rigidity of the finished building.

The intermediate section 16 has a generally U-shaped cross-section. A first section 28 of the intermediate section is disposed in the same plane as the first connecting plate 12 and the second connecting plate 14. A second section 30 and a third section 32 are respectively joined to the outside edges of the first section 28 and project orthogonally downward from the outside edges of the first section 28 in the same direction as the teeth 22, the first spacing members 24 and the second spacing member 26. The depth of each of the sections 30 and 32 is preferably approximately equal to one-third of the width of section 28 which maximizes the strength of the intermediate section 16 to resist bending forces.

Figure 5:
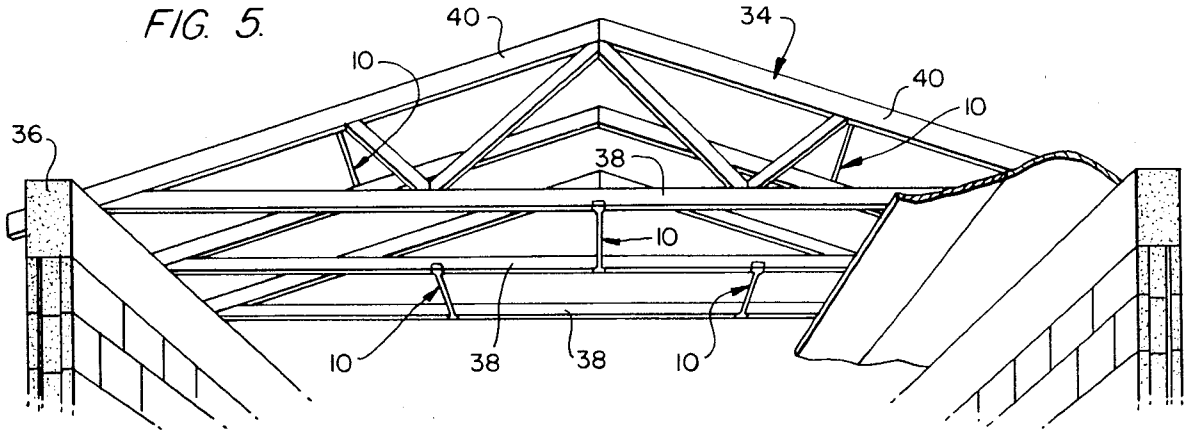
FIG. 5 illustrates a roof truss structure constructed in accordance with the present invention.

A roof truss structure constructed in accordance with the present invention is illustrated in FIG. 5. This roof truss structure is made of a plurality of previously manufactured roof trusses 34. At the beginning of the construction of the roof with the prefabricated roof trusses 34, the first two roof trusses 34 are placed on top of beams 36 which extend orthogonally from the longitudinal axis of the trusses. A truss spacer 10 is attached to the bottom surfaces of the horizontally running wooden members 38 of the trusses 34 by hammering the teeth 22 into the bottom surfaces while the first and second spacing members engage the adjacent facing surfaces of the two wooden members 38. A pair of truss spacers 10 are attached between the adjacent roof trusses 34 to each sloping side 40 in the same manner as described with reference to the attachment of the truss spacer to the underneath side. The adjacent roof trusses 34 in this manner are rigidly interconnected. Each successive roof truss 34 is installed in accordance with this same procedure.

The spacing members 24 and 26 of each truss spacer are important in insuring that each pair of a series of parallel trusses 34 are spaced apart by the same distance. The punching of the spacing means 24 and 26 from the first section 28 of the intermediate section 16 minimizes the steps necessary for manufacturing a truss spacer for insuring acurate spacing between adjacent trusses.

With the present invention, a rectangular blank of metal is used to manufacture the truss spacer 10 which eliminates the need for making additional cuts in a downwardly depending leg such as the truss spacer disclosed in U.S. Pat. No. 3,959,945 wherein the top leg is longer than the downwardly depending leg. The truss spacer of U.S. Pat. No. 3,959,945 must be made from a non-rectangular blank of metal which wastes metal or necessitates additional metal cutting operations.

The truss spacer 10 is preferably symmetrical about a center line which bisects the connection plates 12 and 14 and the intermediate section 16. The truss spacer 10 may be manufactured as a group of six or more individual units which are attached to each other along the adjacent edges of the first connecting plate 12 and the second connecting plate 14 by break away fold lines which are severed by the bending of the adjacent truss spacers.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A truss spacer for interconnecting and maintaining spacing between adjacent spaced apart trusses comprising:

(a) a first connecting plate disposed in a plane and having a plurality of first pairs of teeth projecting generally orthogonally from a surface of said first connecting plate, said first pairs of teeth being arranged in a single column extending along the longitudinal axis of said truss spacer;

(b) a second connecting plate disposed in the same plane as said first connecting plate and having a plurality of second pairs of teeth projecting generally orthogonally from a surface of said second connecting plate, said second pairs of teeth being arranged in a single column extending along the longitudinal axis of said truss spacer, the teeth of both said first and second connecting plates projecting in the same direction;

(c) an intermediate section having a first end and a second end, said first end being joined to the first connecting plate and the second end being joined to said second connecting plate, said intermediate section containing stiffening means for strengthening said intermediate section to resist bending of said intermediate section upon the application of a load;

(d) said intermediate section having a generally U-shape cross-section; said intermediate section including a first section disposed in the same plane as said first and second connecting plates and interconnecting said connecting plates, and second and third sections respectively joined to opposing outside edges of said first section and said second and third sections extending substantially orthogonally to said first section and projecting from said outside edges in the same direction as the teeth of said first and second connecting plates; said first, second and third sections of said intermediate section being of equal length; and first and second spacing means respectively punched from said first and second ends of said intermediate section, said first and second spacing means projecting generally orthogonally from said intermediate section in the same direction as said teeth projecting generally orthogonally from said first and second connecting plates, said first and second spacing means being spaced apart by a distance equal to the desired distance between adjacent surfaces of spaced apart trusses to which said first and second connecting plates are adapted to be connected.

2. A truss spacer in accordance with claim 1 wherein said truss spacer is symmetrical about a center line which bisects the connecting plates and the intermediate section whereby the spacer may be manufactured from a rectangular blank of metal without additional cutting operations to the metal blank.

3. A truss structure comprising:

a plurality of wooden trusses arranged in a spaced parallel arrangement;

a plurality of truss spacers interconnecting and maintaining the spacing between adjacent trusses; and each of said truss spacers including:

(a) a first connecting plate disposed in a plane and having a plurality of first pairs of teeth projecting generally orthogonally from a surface of said first connecting plate, said first pairs of teeth being arranged in a single column extending along the longitudinal axis of the respective said truss spacer;

(b) a second connecting plate disposed in the same plane as said first connecting plate and having a plurality of second pairs of teeth projecting generally orthogonally from a surface of said second connecting plate, said second pairs of teeth being arranged in a single column extending along the longitudinal axis of the respective said truss spacer, the teeth of both said first and second connecting plate projecting in the same direction;

(c) an intermediate section having a first end and a second end, said first end being joined to the first connecting plate and the second end being joined to said second connecting plate, said intermediate section containing stiffening means for strengthening said intermediate section to resist bending of said intermediate section upon the application of a load;

(d) said intermediate section having a generally U-shape cross-section; said intermediate section including a first section disposed in the same plane as said first and second connecting plates and interconnecting said connecting plates; and second and third sections respectively joined to opposing outside edges of said first section and said second and third sections extending substantially orthogonally to said first section and projecting from said outside edges in the same direction as the teeth of said first and second connecting plates; said first, second and third sections of said intermediate section being of equal length; and (e) first and second spacing means respectively punched from said first and second ends of said intermediate section, said first and second spacing means projecting generally orthogonally from said intermediate section in the same direction as said teeth projecting generally orthogonally from said first and second connecting plates, said first and second spacing means being spaced apart by a distance equal to the desired distance between adjacent surfaces of spaced apart trusses to which said first and second connecting plates are adapted to be connected.

4. A truss structure according to claim 3, wherein said truss spacer is symmetrical about a center line which bisects the connecting plates and the intermediate section whereby the spacer may be manufactured from a rectangular blank of metal without additional cutting operations to the metal blank.

* * * * *